US006406277B1

(12) United States Patent
Shafer et al.

(10) Patent No.: US 6,406,277 B1
(45) Date of Patent: Jun. 18, 2002

(54) CENTRIFUGAL PUMP WITH INDUCER INTAKE

(75) Inventors: Terry W. Shafer, Broken Arrow; Joe V. Henry, Claremore, both of OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/721,357

(22) Filed: Nov. 22, 2000

Related U.S. Application Data

(63) Continuation-in-part of application No. 09/033,112, filed on Mar. 2, 1998, now Pat. No. 6,190,141.

(51) Int. Cl.[7] ..... F04B 35/00; F04B 17/00; F04B 3/00; F01D 1/02; F03B 1/04

(52) U.S. Cl. ..... 417/424.2; 417/244; 415/199.2

(58) Field of Search ..... 417/424.2, 205, 417/244; 166/105.5; 415/143, 199.2

(56) References Cited

U.S. PATENT DOCUMENTS 2,273,420 A * 2/1942 Schott ..... 103/103
2,378,974 A * 6/1945 Bower ..... 287/52.05
2,854,926 A * 10/1958 Haight et al. ..... 103/102
3,104,918 A * 9/1963 Horan, Jr. et al. ..... 308/36.1
4,481,020 A 11/1984 Lee et al. ..... 55/203
4,749,034 A 6/1988 Vandevier et al. ..... 166/105
4,838,758 A * 6/1989 Sheth ..... 415/140
5,482,117 A * 1/1996 Kolpak et al. ..... 166/265
5,516,360 A 5/1996 Normandeau et al. ..... 96/207

* cited by examiner

*Primary Examiner*—Charles G. Freay
*Assistant Examiner*—Timothy P. Solak
(74) *Attorney, Agent, or Firm*—Bracewell & Patterson, L.L.P.

(57) ABSTRACT

An electrical submersible well pump assembly has an inducer and diffuser for applying a positive pressure to the first pump stage. The pump assembly includes a centrifugal pump with a housing having a well fluid inlet and a number of pump stages. Each pump stage has an impeller and a diffuser. An inducer is mounted in the housing upstream of the impeller of the first pump stage. The inducer has a helical flight that is rotatable in unison with the pump. A diffuser is positioned between the inducer and the impeller of the first stage.

14 Claims, 2 Drawing Sheets

CENTRIFUGAL PUMP WITH INDUCER INTAKE

This application is a continuation-in-part of application Ser. No. 09/033,112, filed Mar. 2, 1998, now U.S. Pat. No. 6,190,141.

BACKGROUND OF THE INVENTION

1. Field of the Invention

This invention relates in general to electrical submersible well pumps, and in particular to a centrifugal pump with an impeller and diffuser located before the first impeller of the pump.

2. Description of the Related Art

A common electrical submersible well pump of a type used for oil wells has a centrifugal pump that is driven by a downhole electrical motor. The pump has a large number of stages, each stage having an impeller and diffuser. These pumps work well for delivering large volumes of liquid, principally oil and water, of medium viscosity.

Significant amounts of gas present can present problems because a centrifugal pump does not operate efficiently with large amounts of entrained gas. A gas separator may be incorporated into the pump assembly for separating out gas prior to reaching the first pump stage. Still, in some cases, the fluid pressure is inadequate at the first stage due to the presence of gas in the well fluid.

High viscosity well fluid can also present problems for centrifugal pumps because the viscous fluid may not feed adequately into the first stage. Inadequate feed pressure at the first stage may also occur in highly deviated or horizontal wells.

BRIEF SUMMARY OF THE INVENTION

According to the present invention, a centrifugal pump for use in an electrical submersible well pump assembly is provided that includes a multi-stage submersible pump having impellers for displacing well fluid. An inducer is attached to the pump for inducing well fluid to flow into the pump. The inducer has a helical flight similar to an auger. A diffuser is provided between the inducer and the first impeller of the pump for channeling flow from the inducer into the eye of the impeller. The diffuser is a mixed flow type, having passages that incline inward from the upstream end to the downstream end.

The inducer converts rotational energy to head and flow. The diffuser converts the rotational energy from the inducer into velocity head and channels the flow into the eye of the first impeller of the pump. These attributes are useful in high gas environments and high viscosity environments.

DETAILED DESCRIPTION OF THE PREFERRED EMBODIMENT

Figure 1:
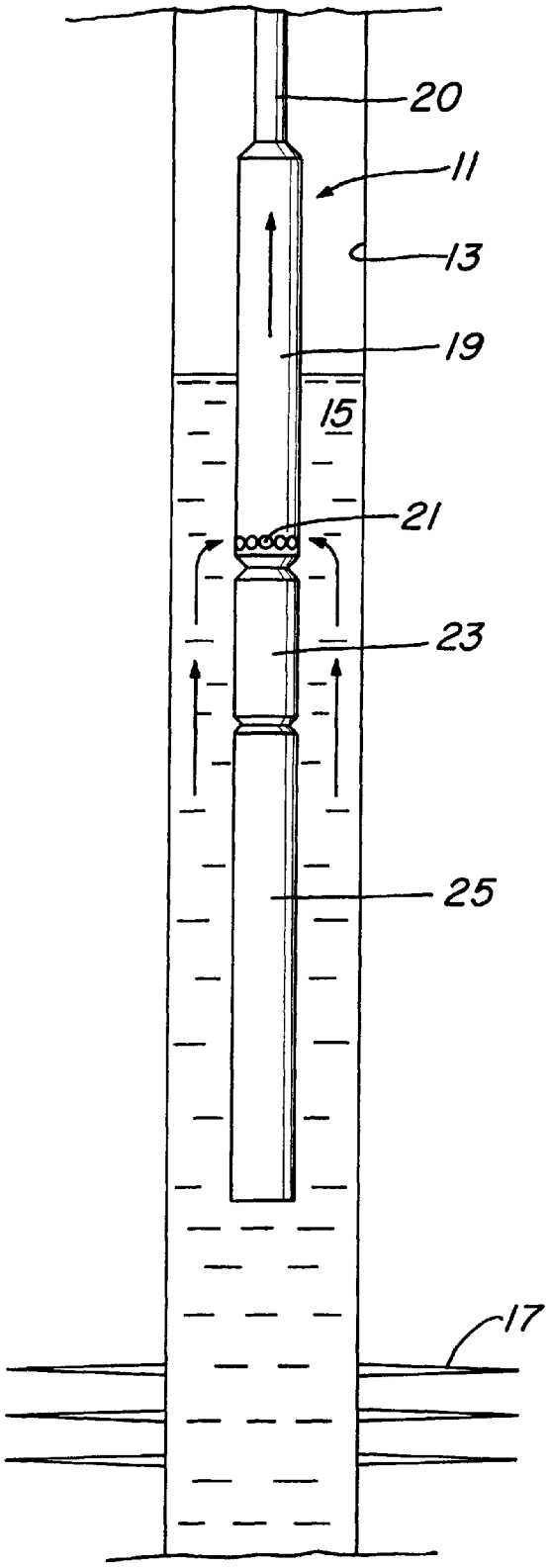
FIG. 1 is a schematic view illustrating an electrical submersible pump assembly installed in a well and having a diffuser in accordance with this invention.

Referring to FIG. 1, an electrical submersible pump assembly 11 is shown installed within a well 13. Well 13 contains a well fluid 15, which flows inward from perforations 17. In the application of this invention, well fluid 15 will typically be a heavy viscous crude or it may contain a large percentage of gas.

Pump assembly 11 includes a centrifugal pump 19 which has a well fluid inlet or lower intake 21. Pump 19 is suspended by a string of production tubing 20, and its lower end is mounted to a conventional seal section 23. An electrical motor 25 is supported on the lower end of seal section 23. Seal section 23 seals well fluid from lubricant within electrical motor 25 and also reduces the pressure differential between the hydrostatic pressure in the well and the internal pressure of the lubricant in the motor. Additionally, seal section 23 has thrust bearings for absorbing axial thrust generated by pump 19. Electrical motor 25 is a large AC motor which is supplied with electrical power through a power cable (not shown) extending down from the surface.

Figure 2A:
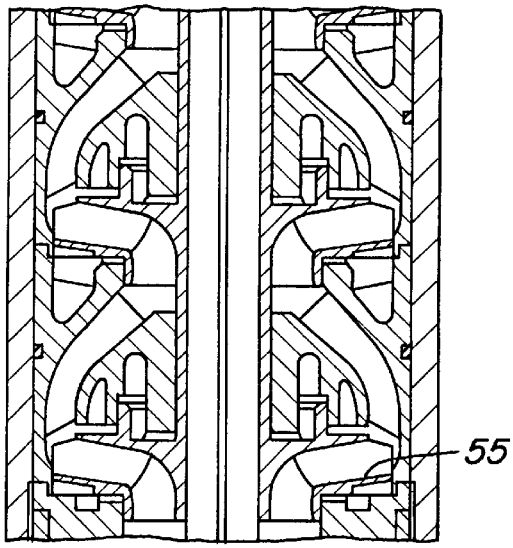
FIGS. 2A and 2B comprise an enlarged sectional view of a lower portion of the pump of FIG. 1.
Figure 2B:
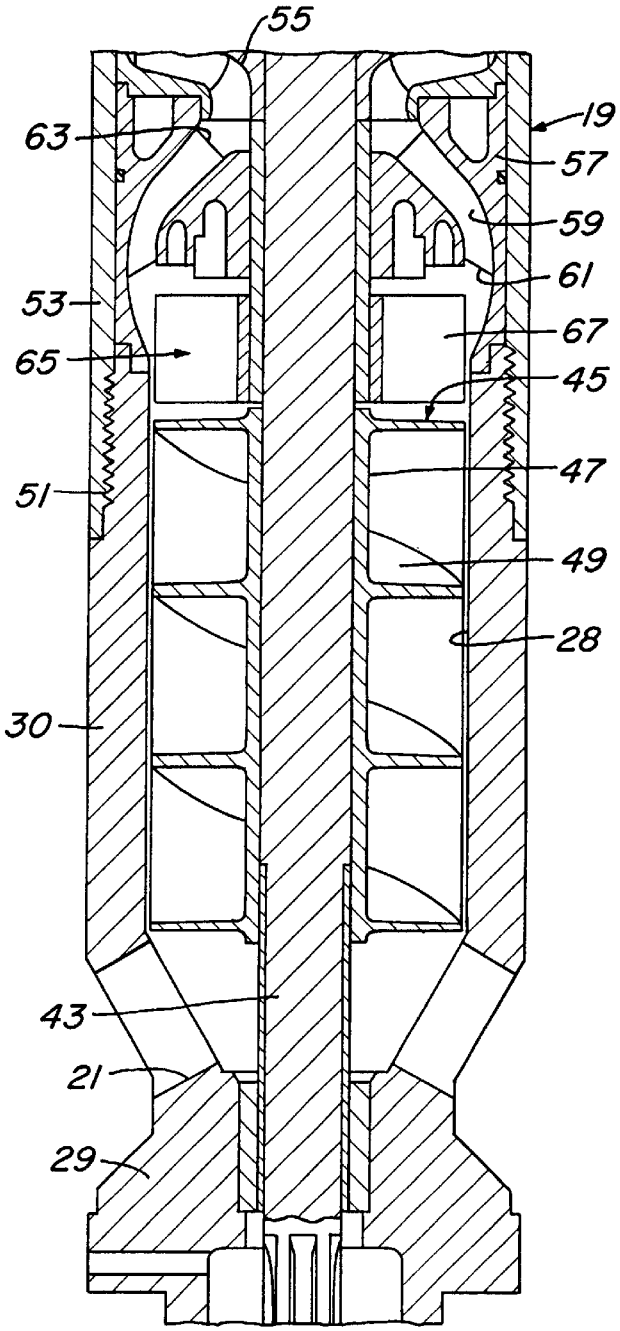

Referring to FIG. 2B, the lower end of pump 19 has a pump base 29 affixed thereto. Pump base 29 is secured by bolts (not shown) to seal section 23 (FIG. 1). Pump base 29 is a tubular member having a sidewall 30 that defines a bore 28. Intake ports 21 are located in sidewall 30.

An axial shaft 43 extends through pump base 29. Shaft 43 couples to a shaft (not shown) extending upward from seal section 23 (FIG. 1), which is driven by electrical motor 25 (FIG. 1). An inducer 45 is mounted to shaft 43 and located within bore 28. Inducer 45 is a helical screw pump, having a hub 47 that slides over shaft 43 and rotates with shaft 43 by means of a key. A flight 49 extends outward from hub 47. Flight 49 is helical and has an outer periphery in close proximity to sidewall 30 of pump base 29. Inducer 45 has a length that is less than the length of pump base 29.

Pump base 29 has a set of exterior threads 51 on its upper end. A tubular housing 53 secures pump base 29 to an upper portion of pump 19. Pump base 29 may be considered to be a lower portion of housing 53. Pump 19 has a large number of substantially identical pumping stages, each stage having a rotating impeller 55 and stationary diffuser 57, as shown also in FIG. 2A. Unlike a conventional centrifugal pump, the lowermost element of pump 19 is one of the diffusers 57, not one of the impellers 55. The first stage of a typical prior art pump will have an impeller 55 as the upstream element rather than a diffuser 57.

Pump 19 is preferably a mixed flow type as opposed to a radial flow type. That is, each stage creates significant axial flow as well as radial flow. A radial flow stage principally creates radial flow. Each diffuser 57 has a plurality of diffuser passages 59, each having a lower or upstream end 61 and an upper or downstream end 63. The upstream ends 61 are spaced radially from shaft43 a greater distance than the downstream ends 63. Being a mixed flow type, the passages 59 incline radially inward from the upstream ends 61 to the downstream ends 63. A significant axial distance exists between upstream ends 61 and downstream ends 63. Conversely, in a radial flow diffuser (not shown), the passages extend principally radially and not axially.

A guide vane 65 is optionally mounted between inducer 45 and the first diffuser 57. Guide vane 65 is keyed to shaft 43 for rotation therewith and has a plurality of blades 67. Guide vane 65 serves to prevent fluid pre-rotation as the fluid passes from inducer 45 into the lowermost diffuser 57. However, guide vane 65 could be omitted, allowing flow to pass directly from inducer 45 into the lowermost diffuser 57.

In operation, electrical power is supplied to motor 25 to drive pump 19. As indicated by the arrows in FIG. 1, well fluid 15 flows into intake ports 21. Inducer 45 rotates with shaft 43, acting as a low pressure pump stage to induce flow into the lowermost diffuser 57. Guide vane 65, if employed, receives the flow from inducer 45 and tends to reduce swirling of the well fluid. The well fluid flows through passages 59 of the lowermost diffuser 57, then into the eye or inlet of the lowermost impeller 55. The lowermost diffuser 57 converts the flow from inducer 45 into velocity head.

The invention has significant advantages. In high gas environments the invention mixes the gas and liquid and raises fluid pressure at the entrance of the first pump stage. In high viscosity environments the invention positively feeds fluid to the first pump stage. In a horizontal application, the inducer and diffuser increase the feed pressure at the first pump stage. Another benefit is that pressure and flow will be provided to the first impeller even if there is partial blockage of the intake of the first impeller since inducer is a positive displacement device.

While the invention is shown in only one of its forms, it should be apparent to those skilled in the art that it is not so limited, but is susceptible to various changes without departing from the scope of the invention. For example, a gas separator may also be employed with the pump assembly.

We claim:

1. An electrical submersible well pump assembly comprising:

a centrifugal pump having a housing with a well fluid inlet and a plurality of pump stages contained in the housing, the stages including an inlet stage having an impeller located downstream from the inlet;

an inducer mounted in the housing upstream of the impeller of the inlet stage, the inducer having a helical flight;

a rotatable shaft extending through the inducer and the stages of the pump for rotating the inducer and the impellers;

a diffuser positioned between the inducer and the impeller of the inlet stage; and the housing and the shaft defining an annular sealed enclosure between the inducer and the diffuser, so as to require all well fluid entering the inlet to flow to the diffuser.

2. The pump assembly according to claim 1, wherein the diffuser is a mixed radial and axial flow member.

3. The pump assembly according to claim 1, further comprising a rotatable guide vane having a plurality of blades and mounted between the inducer and the diffuser.

4. The pump assembly according to claim 1, wherein the diffuser comprises a member mounted stationarily in the housing and having a plurality of passages, each having an upstream end and a downstream end, and wherein the upstream ends are spaced farther from a longitudinal axis of the pump than the downstream ends.

5. The pump assembly according to claim 1, wherein the diffuser comprises a member mounted stationarily in the housing and having a plurality of passages, each having an upstream end and a downstream end, the upstream ends being spaced a radial distance that is farther from a longitudinal axis of the pump than the downstream ends, the passages inclining inward relative to the axis from the upstream ends to the downstream ends.

6. The pump assembly according to claim 1, wherein the inducer is located downstream of the well fluid intake.

7. An electrical submersible pump assembly, comprising:

a centrifugal pump having a housing containing a rotatably driven shaft that drives a plurality of impellers, the housing having a well fluid inlet for receiving a well fluid containing liquid and gas;

an inducer having a helical flight, the inducer being located in the housing and rotated by the shaft;

a diffuser stationarily mounted in the housing downstream of the inducer and upstream of a first one of the impellers, the diffuser having a plurality of passages extending from an upstream end of the diffuser to a downstream end of the diffuser, the passages being spaced farther from the shaft at the upstream end of the diffuser than at the downstream end; and the housing and the shaft between the inducer and the diffuser defining a closed annular passage so as to require all of the gas and liquid flowing into the inlet to flow to the diffuser and the impellers.

8. The pump assembly according to claim 7, further comprising:

a guide vane mounted to the pump for rotation therewith, the guide vane being located between the inducer and the diffuser member.

9. The pump assembly according to claim 7, wherein the well fluid inlet is located upstream of the inducer.

10. The pump assembly according to claim 7, wherein the passages of the diffuser are inclined relative to the shaft.

11. A method of pumping well fluids comprising:

flowing well fluids into a housing of a centrifugal pump assembly;

rotating an inducer in the housing to cause the well fluid to flow through the housing; then passing all of the well fluid through a diffuser located in the housing; then passing the well fluid into an impeller of a first stage of the centrifugal pump assembly.

12. The method according to claim 11, wherein passing the well fluid through the diffuser comprises directing flow axially and radially inward relative to an axis of the centrifugal pump assembly.

13. The method according to claim 11, wherein the well fluid contains liquid and gas, and all of the liquid and the gas are passed from the inducer through the diffuser and into the impeller of the first stage.

14. A method of pumping well fluids containing liquid and gas, comprising:

providing a pump having a housing, a helical vane, and a plurality of stages, each stage having a diffuser and an impeller;

rotating the helical vane and the impellers;

flowing liquid and gas into the housing, and conveying the liquid and gas through the helical vane;

after passing from the helical vane, directing all of the flow of liquid and gas axially and radially inward, relative to an axis of the pump, into the stages of the pump; then pumping all of the flow of liquid and gas through the pump with the stages of the pump.

* * * * *